US011562640B2

(12) United States Patent
Brown

(10) Patent No.: US 11,562,640 B2
(45) Date of Patent: Jan. 24, 2023

(54) WEARABLE STRAP

(71) Applicant: Patrick Brown, London (GB)

(72) Inventor: Patrick Brown, London (GB)

( * ) Notice: Subject to any disclaimer, the term of this patent is extended or adjusted under 35 U.S.C. 154(b) by 0 days.

(21) Appl. No.: 17/264,399

(22) PCT Filed: Aug. 5, 2019

(86) PCT No.: PCT/GB2019/052194
§ 371 (c)(1),
(2) Date: Jan. 29, 2021

(87) PCT Pub. No.: WO2020/030895
PCT Pub. Date: Feb. 13, 2020

(65) Prior Publication Data

US 2021/0312787 A1 Oct. 7, 2021

(30) Foreign Application Priority Data

Aug. 6, 2018 (GB) ..... 1812774

(51) Int. Cl.
*G08B 21/24* (2006.01)
*G08B 25/00* (2006.01)
*A41F 9/00* (2006.01)

(52) U.S. Cl.
CPC ..... *G08B 21/24* (2013.01); *G08B 25/001* (2013.01); *A41F 9/002* (2013.01)

(58) Field of Classification Search
CPC ..... G08B 1/00; H04W 4/00
See application file for complete search history.

(56) References Cited

U.S. PATENT DOCUMENTS 5,565,845 A * 10/1996 Hara ..... A63B 55/00 340/687
6,472,986 B1 * 10/2002 Sorriaux ..... G08B 21/0247 340/568.1

(Continued)

FOREIGN PATENT DOCUMENTS

CN 101642293 A 2/2010
CN 102687943 A 9/2012

(Continued)

OTHER PUBLICATIONS

Search Report, GB1812774.6, dated Feb. 7, 2019.
International Search Report, PCT/GB2019/052194, dated Dec. 11, 2019.

*Primary Examiner* — Curtis J King
(74) *Attorney, Agent, or Firm* — Invention To Patent Services; Alex Hobson

(57) ABSTRACT

A wearable strap 10 comprising releasable connection means 14 for securing the strap 10 around part of a person's body, a detector for wirelessly detecting an electronic device, a controller 16 programmed with at least one predetermined threshold for a distance between the strap 10 and electronic device, and at least one of: a) alert means 26*a*, 26*b* including at least a speaker or vibrator in the strap 10, and b) signalling means in the strap for sending a signal to a remote location, such as initiating an alert from the electronic device; the controller 16 being configured to use the detector to monitor the distance between the strap 10 and electronic device, and the controller 16 being configured to initiate the alert means 26*a*, 26*b* and/or signalling means to provide an audible or vibrating alert when the distance between the strap 10 and electronic device exceeds the predetermined threshold.

20 Claims, 3 Drawing Sheets

(56) References Cited

U.S. PATENT DOCUMENTS 6,510,421 B1* 1/2003 Ganesh ..... G06F 16/2343
8,700,710 B1 4/2014 Gallagher
8,810,392 B1* 8/2014 Teller ..... G08B 21/24 340/572.1
9,569,948 B1* 2/2017 Platt ..... G08B 21/22
9,779,612 B2* 10/2017 Darval ..... G08B 21/24
9,886,837 B1* 2/2018 Alexander ..... G08B 21/24
10,303,961 B1* 5/2019 Stoffel ..... G01C 21/3697
10,573,162 B1* 2/2020 Barrera ..... B60R 25/245
10,573,163 B1* 2/2020 Benkreira ..... G06V 40/167
10,645,534 B1* 5/2020 Klinkner ..... H04W 4/029
10,708,722 B1* 7/2020 Klinkner ..... G01S 5/02
2001/0038330 A1* 11/2001 Garcia ..... G08B 21/0247 340/568.4
2002/0183982 A1* 12/2002 Rauscher ..... G06F 30/13 703/1
2003/0018711 A1* 1/2003 Imanishi ..... G06Q 30/0267 707/999.107
2003/0169171 A1* 9/2003 Strubbe ..... G08B 21/0423 340/573.1
2006/0154642 A1* 7/2006 Scannell ..... G08B 7/066 455/404.1
2006/0234631 A1 10/2006 Dieguez
2006/0258407 A1* 11/2006 Chien ..... H04M 1/72454 455/567
2006/0273930 A1* 12/2006 Godden ..... G08G 3/02 340/988
2007/0025808 A1* 2/2007 Penn ..... B42F 7/06 402/75
2007/0096933 A1 5/2007 Wale et al.
2008/0085706 A1* 4/2008 Nagata ..... G08B 21/24 455/435.1
2010/0087183 A1* 4/2010 Porro ..... G08B 21/24 455/420
2011/0214158 A1* 9/2011 Pasquero ..... H04B 5/00 726/2
2012/0171956 A1* 7/2012 Lee ..... H04B 17/23 455/41.2
2013/0196612 A1* 8/2013 Cepuran ..... G08B 21/025 455/404.1
2013/0278413 A1 10/2013 Aujla et al.
2013/0314226 A1* 11/2013 Zhang ..... F24C 7/082 340/539.11
2014/0053248 A1* 2/2014 Hulusi ..... G06F 16/22 726/4
2014/0145845 A1* 5/2014 Sattari ..... G08B 21/24 340/539.13
2014/0253338 A1* 9/2014 Jennings, III ..... G08B 21/24 340/686.6
2014/0335730 A1* 11/2014 Grant ..... G08B 13/1463 439/620.01
2015/0170496 A1* 6/2015 King ..... G08B 21/24 340/686.6
2015/0373091 A1 12/2015 Sanghavi
2016/0049069 A1 2/2016 Oliveira
2016/0050303 A1* 2/2016 Larriviere ..... H04B 1/3888 455/575.8
2016/0063847 A1* 3/2016 Hawkins ..... G08B 21/0277 340/539.11
2016/0330593 A1* 11/2016 Caperell ..... H04W 4/40
2017/0098284 A1* 4/2017 Schneider ..... G06Q 10/1095
2017/0103643 A1* 4/2017 Powers, III ..... E05G 1/02
2017/0193797 A1* 7/2017 Gschwind ..... H04W 4/02
2017/0244934 A1* 8/2017 Chien ..... G06T 7/70
2018/0053398 A1* 2/2018 Kharbawi ..... G08B 21/24
2018/0068544 A1* 3/2018 Caperell ..... H04W 4/027
2018/0108243 A1* 4/2018 Scherer ..... H04W 4/02
2018/0206177 A1* 7/2018 Daoura ..... H04W 4/12
2018/0285454 A1* 10/2018 Agrawal ..... G06Q 10/00
2018/0290622 A1* 10/2018 Mori ..... H04M 11/00
2018/0357547 A1* 12/2018 Yamada ..... H04W 4/70
2019/0103012 A1* 4/2019 Daoura ..... G08B 21/0227
2019/0279488 A1* 9/2019 Sasaki ..... G06F 9/542
2019/0354875 A1* 11/2019 Madden ..... H04L 12/2803
2019/0356505 A1* 11/2019 Madden ..... H04L 12/2812
2020/0137547 A1* 4/2020 Affeldt ..... H04W 8/005
2020/0169848 A1* 5/2020 Daoura ..... H04W 4/80
2020/0184158 A1* 6/2020 Kuczmarski ..... G06N 3/084
2020/0202149 A1* 6/2020 Zhang ..... G08B 7/06
2021/0219095 A1* 7/2021 Iyer ..... H04W 4/80
2021/0236376 A1* 8/2021 Siegel ..... A61H 3/04
2021/0335119 A1* 10/2021 Hakobyan ..... A45B 3/00

FOREIGN PATENT DOCUMENTS

CN 105639891 A 6/2016
CN 106263204 A 1/2017
CN 107073895 A 9/2017
CN 108113127 A 6/2018
GB 2446217 A 8/2008
GB 2487074 A 7/2012
GB 2536879 A 10/2016
WO 20110154956 A1 12/2011
WO 2013148899 A1 10/2013
WO 2018032381 A1 2/2018

* cited by examiner

WEARABLE STRAP

The present invention relates to a wearable strap.

BACKGROUND TO THE INVENTION

Mobile phones, tablets and c-readers are examples of electronic devices which are frequently used in public places. On occasion, these devices are accidentally forgotten on a table or seat, for example, because the owner is distracted by events around them. This may happen when leaving a restaurant or disembarking from a bus, for example. Alternatively, a phone can slip out of a person's pocket, due to the angle of the seat, for example in a taxi. In other cases, an electronic device can be stolen, whether left on a table momentarily or via pickpocketing.

These are just some examples of the scenarios in which a person can become separated from their electronic device. It is generally problematic, if not impossible, for the owner to recover their device. This means that not only have they probably lost the device but, amongst other things, all of the photographs and contact details on their phone, unless they happen to have the information backed up on an online account, for example.

There are devices which provide reminders as a prompt not to forget a phone or keys, for example. However, it is just as easy to forget or lose those devices. For example, a bag containing the electronic device and reminder device may be left behind. Bringing along another device also takes up valuable space in a bag or pocket.

It is an object of the present invention to reduce or substantially obviate the aforementioned problems.

STATEMENT OF INVENTION

According to the present invention, there is provided a wearable strap comprising releasable connection means for securing the strap around part of a person's body, a detector for wirelessly detecting an electronic device, a controller programmed with at least one predetermined threshold for a distance between the strap and electronic device, and at least one of: a) alert means including at least a speaker and/or vibrator in the strap, and b) signalling means in the strap for sending a signal to a remote location, such as initiating an alert from the electronic device; the controller being configured to use the detector to monitor the distance between the strap and electronic device, and the controller being configured to (in use) initiate the alert means and/or signalling means to provide an audible or vibrating alert when the distance between the strap and electronic device exceeds the predetermined threshold, in which the controller is configurable to suppress alerts when the releasable connection means is unfastened.

Optional features are presented in the dependent claims.

The strap therefore monitors whether an electronic device is present, and activates an alarm if the electronic device is not kept within a certain distance of the person wearing the strap. This particularly applies to mobile phones, but also to other mobile/portable electronic devices. Using a strap is advantageous because, in public, it remains on the body of the person wearing it. It is not another device to take up space in a bag or pocket, or to be forgotten alongside the electronic device. Where the person does not have any pockets in their clothing, it is particularly useful to be able to wear the strap. If the person wearing the strap moves too far away from their phone, the strap triggers an alert as a reminder and the wearer can quickly retrieve it. The strap may be configured to do this for a plurality of electronic devices. Audible and vibrating alerts may be provided at the same time.

The strap may be provided as part of a wrist-worn device, such as a watch, for example. However, the predetermined threshold should have a higher tolerance (e.g. a timer delay) to transient actions which may cause the strap to temporarily move too far away from the electronic device, so that the alert is not triggered unnecessarily. The strap may be provided as part of a hag strap, for example.

The strap may be provided in or as part of a belt. This is particularly advantageous because the wearer is very unlikely to remove their belt in a public location. Thus, the belt cannot be left 'on the side' and forgotten alongside the electronic device. This virtually guarantees that the wearer will be reminded if they forget their device. Also, because a belt is usually located around the waist, the position of the belt has low potential uncertainty, relative to a strap on the wrist. This is because arms have a much larger range of movement than the waist, and so a larger range of possible positions.

The strap may include a buckle. Any feature or combination of features below may be incorporated into the buckle instead of or in addition to the strap. The buckle may be provided at one end of the strap. Alternatively, the buckle may be provided in two parts, the parts being mounted at either end of the strap. The strap may have adjustment means for fitting the strap to the wearer. The belt may be at least 0.5 metres long.

The controller may be configured to cease the audible or vibrating alert when the distance between the strap and electronic device is decreased below a second predetermined threshold. This means that the alert stops automatically when the wearer moves back to collect their electronic device.

The second threshold may be the same as the first threshold. If the second threshold is the same as the first threshold, then the user may need to take a couple of steps back towards the device, for example. If the second threshold is set according to the increase in distance between the strap and device (and optionally the motion of the user), for example, then the act of halting and/or turning around may be sufficient to deactivate the alert. Manual alert deactivation means may be provided. The deactivation may be for a temporary period, or may last until alerts are reactivated.

The signalling means may include a wireless communication system for wirelessly connecting the strap to the electronic device. The wireless communication system may be configured to initiate the alert by in use sending a signal instructing the electronic device to provide the alert. For example, the strap may detect, or connect to, the device via Bluetooth® or a wireless field generated by the device, e.g. WiFi®.

Alternatively, rather than connecting to the device, the detector may be configured or trained to recognise a signature corresponding to a particular device. This means that the strap does not need to actively connect to the electronic device. It can just passively detect the electronic device. This may involve fixing a secondary element to the device, where the secondary element is recognised rather than the device itself. However, for security, it is preferable for the strap to recognise the device directly.

The detector may continuously or periodically monitor the presence of the electronic device. If periodic, the period may be substantially less than 5 seconds. The period may be less than 3 seconds. The period may be less than 1 second. The period may be set depending on the location of the strap during use.

The controller is configurable to suppress alerts when the releasable connection means is unfastened. This avoids alerts occurring when the strap is taken off at home, for example.

The strap may include a location sensor. The controller may be connected to the location sensor. The controller may be configurable to set at least one custom location where alerts are suppressed or delayed, for example at home or in a school. The controller may be configurable to adopt a set of locations where alerts are suppressed and not suppressed. For example, a map may be available which automatically includes public locations for alert activation. This avoids alerts occurring in home locations.

The detector may be configured to passively detect a signal or field generated by the electronic device. The predetermined threshold may include a signal strength threshold or a field strength threshold. The controller may be configured to initiate the alert means and/or the signalling means when the strength of the signal or field drops below the signal or field strength threshold. This avoids the need to 'pair' the device with the strap. This provides a one-way device monitoring system.

The controller may be configured to distinguish between movement of the strap away from the electronic device, and movement of the electronic device away from the strap. For example, if a movement sensor is included in the strap, then data corresponding to strap movement can be assessed to determine which of these scenarios applies. Sensors in the electronic device may be used to indicate device motion to the controller instead or in addition to a movement sensor in the strap.

In the first instance, where the strap moves away from the device, this signifies that the user has forgotten the device. In the second instance, this signifies that the device has been taken from the user. Different alerts may be used in each situation. For example, different alert types, alert intensities and/or origins of alerts may be used. A loud audible alert from the phone may be used for the second scenario which corresponds to theft. There may be a shorter delay for initiating the alert in the second scenario, for example.

The strap may include a movement sensor, such as an accelerometer. The controller may be configured to use data from the movement sensor in the strap or a movement sensor in the electronic device to determine whether to initiate the alert. In other words, the controller may be configured to set or use a value for the predetermined threshold according to the movement of the wearer.

For example, if the user stands up or turns away from the electronic device, this may be used to initiate an alert even though the user has not yet travelled a distance away from the device. In this case, the predetermined threshold is effectively lowered by the strap, because the strap is predicting that the device has been forgotten. The controller may still require further motion away from the device to initiate the alert. However, movement of the user is taken into account in determining whether to activate the alert.

The value of the or each predetermined threshold may be customisable. A series of threshold conditions may be provided and used to determine when to initiate an alert. A delay can be set before the alert is triggered. For example, the delay may be 3 seconds. The delay may be 2 seconds. The delay may be 1 second. The delay may be half a second. There may be no delay.

A plurality of vibrators may be spaced along the strap. The controller may be configured to control the vibrations generated by the vibrators based on a detected relative location for the electronic device, for indicating the direction to the electronic device. This allows the user to sense which direction to go in to reach their device most easily.

At least one dummy camera may be mounted in or to the strap. This serves as a potential deterrent to other people that might otherwise seek to harass the wearer in one way or another, as they will be wary of being recorded.

At least one optical device may be provided on the strap. Preferably, four cameras are provided facing to the front, the back, and both sides. The optical device may include a night-vision mode. This allows information to be recorded in the event that the wearer is harassed, including at night. A plurality of optical devices may be mounted along the strap. This allows information to be recorded in front of, behind, and/or to the side of the wearer. In other words, the field of view available via the recordings spans greater than the human field of view, and preferably covers a 360° field of view.

The optical device may include a spectrometer or spectrographic functionality. This allows the optical device to detect dangerous materials such as explosives or precursor compounds, and optionally to warn the wearer accordingly. For example, a particular alert could be issued to direct the wearer away from the source of potential danger.

The optical devices may record simultaneously or at different times. Recording for the or each optical device may be triggered by sensor input. For example, if a sound is detected behind the person, then a rear-facing camera may be activated. Recording may be voice-activated by the wearer, for example.

The strap may include a data storage device or a port for receiving a data storage device. The optical device may be connected to the data storage device or port for storing one or more recorded images.

The controller may be configured to send one or more recorded images from the optical device to the electronic device. This allows data to be recorded on the electronic device. It can also optionally be transmitted to a remote location, e.g. a monitoring station. The optical device may be a camera or a video camera. The optical device may include a wide angle lens, such as a fish-eye lens.

The strap may include a microphone. The microphone may be configured to send one or more sound recordings to the electronic device via the signalling means. The microphone may be part of the optical device.

At least one electronic device holder (such as a phone holder) may be connected to the strap. The electronic device holder may be adjustable for accommodating the size of a given electronic device. For example, an adjustable clamp may be provided. This allows the user to mount their device, e.g. a phone, to the strap. Any camera on the device is then able to record images in front of the person. This is similar to a body-cam used by police, for example.

At least one lockable storage compartment or box may be provided on the strap. This allows the user to store valuables in the or each compartment. This may include one or more of: a mobile phone, cash, payment cards, a music device, and other small objects. This is useful if the wearer does not have much (or any) space in their pockets, for example. The compartment may be rotatable or mounted on the strap by a swivel mechanism. The compartment may be releasably attachable to the strap at a rear face of the compartment. The compartment may be extendable from the strap, such as via a bungee cord. A music device may be integrated into the compartment.

An authentication token may be included in the strap or provided on a wearer-facing surface of the strap. This allows the user to remotely link the strap to a monitoring station. Data from the strap can be manually or automatically run through a filter to determine if the wearer is in need of aid, for example, if signature sounds or images are detected. This may apply if screams or explosions are detected, for example. The authentication token may be a barcode. The token may be located at a predetermined distance in from an end of the strap.

The strap may include a location tracking system for remotely determining the location of the strap. This can be used to send aid to the necessary location as quickly as possible, if the strap is being monitored. The location tracking system may be provided in the compartment. The location tracking system may by GPS-based or GLONASS-based, for example.

The strap may comprise an alarm system. The alarm system may include an alarm trigger extending along the strap. The alarm system may be connected to the controller for initiating an alarm if the alarm trigger is cut. This signifies that the strap has been forcibly removed and that the user may need assistance. The alarm may be an audible sound from the strap, and/or may be a remote signal which indicates a request for assistance, for example. The remote signal may include data relating to a location, images and/or sound in the vicinity of the strap.

The strap may comprise a power source and a charging system for transferring power from the power source to the electronic device in the holder. This allows a phone to be recharged whilst mounted to the strap, so that it does not run out of power whilst recording. The strap may include a separate charging system to charge the power source itself. The charging system for the power source may include a kinetic charging system for generating electrical energy from the movement of the wearer. The strap may include a charging connector for recharging the power source from mains power.

The strap may comprise input means for configuring the strap. For example, the input means may allow configuration of one or more of the controller, the alert means, and the signalling means. The input means may be a keyboard or keypad, for example. The input means may be an air-pressured keyboard. A security code may be used to unlock the input means for use. A security code may be used to initiate or deactivate the strap for priming or suppressing alerts. One or more of the following may be provided as input means on or for the belt: one or more switches; one or more buttons; a touchscreen. The electronic device may be used as an interface for configuring the strap or belt.

The strap may be configured to require a security code to be entered in order to remove the electronic device from the holder. If the electronic device is removed prior to a correct code being entered, then an alert may be issued.

The speaker may be any device capable of emitting sound. The or each alert may be customisable. For example, a particular song or sound may be played if the wearer has moved away from their electronic device. A constant vibration or vibration pattern may be used instead or in addition an audible alert. If the electronic device has been stolen and is moving away from the wearer of the strap, then a different alert may be used. The alert may be outputted from the electronic device and/or the strap.

The strap may be waterproof, or made of/enclosed by a waterproof material. An earpiece may be used in conjunction with the strap. The earpiece may connect wirelessly via the signalling means, for example. This allows an audible alert to be provided discreetly via the earpiece. The earpiece may connect via Bluetooth®, either in the strap or via the phone.

The strap may wirelessly communicate with one or more electronic devices. The strap may include a number of connection points for connecting to multiple electronic devices. The strap may be configurable to allow particular phone functions to be operated remotely, such as call diversion. Audio from a phone could be played through the strap speaker. The strap may allow recordings to be wiped via the input means.

The strap may be configurable to provide signals to a television and/or computer. For example, if the wearer gets up and walks away from the TV or computer, the strap may be configured to issue a signal which turns off the TV or computer. If the wearer answers a phone call, the strap may be configured to turn down or mute the volume of the TV or computer.

According to a second aspect of the invention, there is provided a wearable strap and an electronic device configured to communicate with the strap, the strap comprising releasable connection means for securing the strap around part of a person's body, and the electronic device comprising a detector for wirelessly detecting the strap, and a controller programmed with at least one predetermined threshold for a distance between the electronic device and strap, wherein a) the electronic device includes alert means including at least a speaker and/or vibrator, and/or b) the strap includes alert means including at least a speaker and/or vibrator, and the electronic device includes signalling means for sending a signal to the strap for initiating the alert means of the strap;

the controller in the electronic device being configured to use the detector to monitor the distance between the electronic device and the strap, and the controller being configured to initiate the alert means and/or signalling means to provide an audible or vibrating alert when the distance between the electronic device and the strap exceeds the predetermined threshold, in which the controller is configurable to suppress alerts when the strap is unfastened.

The strap may include any feature or combination of features presented with respect to the first aspect of the invention. The strap may include a unit or element which is detectable by the detector. For example, the strap may include a receiver and/or a transmitter which can communicate with the detector for allowing the electronic device to detect the strap. The controller may be configurable to suppress alerts when the strap is unfastened or undone.

This has similar advantages to the first aspect of the invention. In this case, the electronic device is adapted to initiate the alert, instead of or in addition to the strap. For example, in the case of a mobile phone, an app may be installed to configure the phone to monitor the distance. Various customisation options may be provided. For example, the distance threshold distance may be selected via the electronic device. The alert may be set and/or customised via the electronic device.

According to a third aspect of the invention, there is provided a personal monitoring system comprising at least one wearable strap comprising releasable connection means for securing the strap around part of a person's body, a sensor unit, and signalling means in the strap for sending data from the sensor unit to a remote location, at least one electronic device for the at least one wearable strap, and a monitoring station at a location remote from the at least one wearable strap, in use, the at least one wearable strap transmitting information to the monitoring station via the signalling means to enable remote evaluation of an event in the vicinity of the at least one wearable strap.

The strap may include any feature or combination of features presented with respect to the first or second aspects of the invention.

This allows the safety of the person wearing the strap to be monitored. The strap can be configured to connect to the remote monitoring station, and a remote assistance is then available via a helpline, for example. Equally, if the wearer is incapacitated or unable to call for help, the strap may allow remote monitoring via sensors in the strap. For example, the sensors may include one or more of the following: a camera, a microphone, a video camera, a pulse rate sensor, an accelerometer, and a location sensor. If the wearer is deemed to be in distress or danger following evaluation of the sensor data, a third party, e.g. the emergency services, can be alerted and directed accordingly.

The strap could be provided on a mannequin or a free-standing object, for example. This could allow the strap to be used to secretly gather evidence in cases of domestic violence or to send a remote distress signal in the event of a burglary, i.e. acting as home recording equipment. The strap need not be worn by a person at the time. The strap need not be secured in a loop, e.g. buckled, at the time either.

According to a fourth aspect of the present invention, there is provided a wearable strap in the form of a belt for use in locating a mobile phone, the belt comprising releasable connection means for securing the belt around a person's waist, a detector for wirelessly detecting the mobile phone, a controller programmed with at least one predetermined threshold for a distance between the belt and mobile phone, and at least one of: a) alert means including at least a speaker or vibrator in the belt, and b) signalling means in the belt for sending a signal to the mobile phone to generate an alert; the controller being configured to use the detector to monitor the distance between the belt and mobile phone, and the controller being configured to in use initiate the alert means and/or signalling means to provide an audible or vibrating alert to the person with the belt when the distance between the belt and mobile phone exceeds the predetermined threshold, to direct the person to the mobile phone.

The belt may include any feature or combination of features presented with respect to any one or more of the first, second and third aspects of the invention.

According to a fifth aspect of the present invention, there is provided a wearable strap comprising releasable connection means for securing the strap around part of a person's body, a detector for wirelessly detecting an electronic device, a controller programmed with at least one predetermined threshold for a distance between the strap and electronic device, and at least one of: a) alert means including at least a speaker or vibrator in the strap, and b) signalling means in the strap for sending a signal to a remote location, such as initiating an alert from the electronic device; the controller being configured to use the detector to monitor the distance between the strap and electronic device, and the controller being configured to initiate the alert means and/or signalling means to provide an audible or vibrating alert when the distance between the strap and electronic device exceeds the predetermined threshold.

According to a sixth aspect of the present invention, there is provided a wearable strap and an electronic device configurable to communicate with the strap, the strap comprising releasable connection means for securing the strap around part of a person's body, and the electronic device comprising a detector for wirelessly detecting the strap, and a controller programmed with at least one predetermined threshold for a distance between the electronic device and strap, wherein a) the electronic device includes alert means including at least a speaker or vibrator, and/or b) the strap includes alert means including at least a speaker or vibrator, and the electronic device includes signalling means for sending a signal to the strap for initiating the alert means of the strap;

the controller in the electronic device being configured to use the detector to monitor the distance between the electronic device and the strap, and the controller being configured to initiate the alert means and/or signalling means to provide an audible or vibrating alert when the distance between the electronic device and the strap exceeds the predetermined threshold.

Either or both of the fifth and sixth aspects of the invention may include any feature or features presented with respect to any of the preceding aspects of the invention.

Any of the aspects of the invention may include any of the following features.

A sensor may detect when the releasable connection means is fastened or unfastened. The controller may use input from the sensor to determine whether to suppress alerts. The sensor may be in the strap. The sensor may be in the releasable connection means.

If the controller is in the electronic device, the sensor may be wirelessly connectable to the controller for establishing whether the strap is fastened or unfastened. To determine the fastened or unfastened status, the sensor may detect a curvature of the strap, or whether the ends of the strap are linked together in a loop, or a separation distance between the ends of the strap, for example.

Unfastening the belt can automatically suppress alerts without the need for further input from the user.

The strap or belt may be a retractable strap or belt.

The strap or belt may include a storage means for retractably storing at least a portion of the strap or belt. The storage means may store at least a portion of the strap or belt in a rolled configuration.

The storage means may comprise a spool onto which one end of the strap or belt is secured. The spool may be connected to an operating mechanism for retracting the strap or belt onto the spool. The operating mechanism may be manual, such as a handle, and/or automatic, including for example a biasing member. The spool may be connected to a biasing member for applying torque to the spool, the biasing member biasing the strap or belt towards the rolled configuration.

The storage means may include a locking mechanism for preventing sudden strap or belt withdrawal from the storage means. The locking mechanism may be formed from a centrifugal clutch mechanism.

The strap or belt may include at least one reinforcement means extending through the length of the belt. The reinforcement means may be a chain or a woven metal fibre. The reinforcement means may be or provide an alarm trigger when cut.

The storage means may be disposed on or in the connection means or buckle.

The strap or belt may be made from leather or other materials. The strap or belt may be or include a laminate structure with at least a first layer and a second layer.

The reinforcement means may be located between a first layer and second layer of material forming the strap or belt. The reinforcement means may be part of a woven structure forming the strap or belt.

A strap or belt tightening mechanism may be disposed on the strap or belt. The tightening mechanism may be adapted to tighten the strap or belt when the strap or belt is secured in a loop around part of the person's body. The tightening mechanism may comprise at least two attachment plates attached to or embedded in the strap or belt and an adjustment means adapted to adjust the distance between the two attachment plates. Each attachment plate may have a coupling means to couple the attachment plate to the adjustment means.

The adjustment means may be or include a rod with a first threaded portion disposed on one end of the rod and a second threaded portion disposed on the opposite end of the rod. The coupling means of the first plate may have a threaded portion corresponding to the first threaded portion of the rod. The coupling means of the second plate may have a threaded portion corresponding to the second threaded portion of the rod. The handedness of the threaded portions may be set so that rotation of the rod about the longitudinal axis causes the distance between the plate to be lessened or extended.

BRIEF DESCRIPTION OF THE DRAWINGS

For a better understanding of the present invention, and to show more clearly how it may be carried into effect, reference will now be made by way of example only to the accompanying drawings, in which.

DESCRIPTION OF PREFERRED EMBODIMENTS

Figure 1:
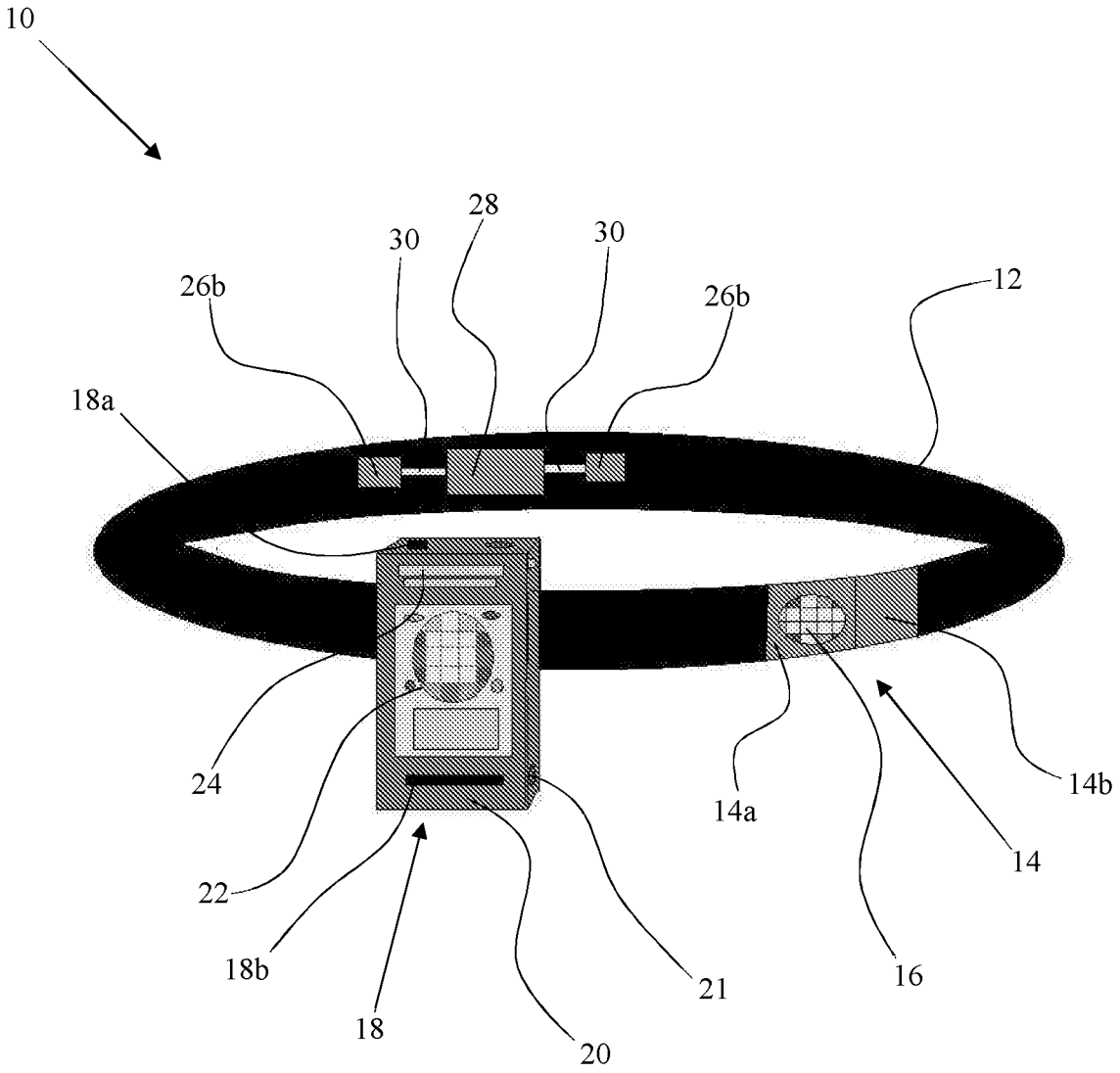
FIG. 1 shows a perspective view of a wearable strap according to the invention.

Referring to FIG. 1, a wearable strap is indicated generally at 10. The strap 10 is a belt in this embodiment. The strap 10 includes a leather body in this embodiment. However, any strong and/or lightweight material may be used.

The strap 10 includes a body 12 and releasable connection means indicated generally at 14. The connection means is a buckle in this embodiment. A first part 14*a* of the buckle is at one end of the body 12. A second part 14*b* of the buckle is at the other end of the body 12. When the buckle parts 14*a*, 14*b* are connected together, the strap 12 forms a closed loop for wearing around the waist in a conventional manner.

The buckle 14 includes a combination lock. When the buckle parts 14*a*, 14*b* are connected, the strap can link up to a remote monitoring station. The strap 10 can be adjusted in length when the buckle 14 is undone. For example, the body 12 can be rolled relative to the buckle 14 to increase or decrease the strap length.

A control unit 16 is provided on the first part 14*a* of the buckle 14. In this embodiment, when the buckle 14 is open, the control unit is deactivated. The control unit 16 includes a controller and a detector for wirelessly detecting a phone. In this embodiment, the control unit 16 is paired with the phone so that the detector can sense the phone, or it detects a Bluetooth® or Wi-Fi® profile of the phone, for example. The signal strength of the connection to the phone or field generated by the phone is assessed by the control unit 16 for monitoring the distance between the phone and strap 10. If it decreases, the phone is judged to be further away. Calibration may be required to set the correct sensitivity.

The controller is programmed with a threshold which is or corresponds to a distance between the strap and detected electronic device. In this embodiment, the distance is 2 metres. However, it will be appreciated that another distance may be used, e.g. 1 metres, 1.5 metres, 3 metres etc.

The control unit 16 includes a wireless communication system for sending signals to the phone or to a remote location (e.g. via satellite). The control unit 16 includes a location sensor. The sensor is a GPS unit.

A phone holder is indicated generally at 18. A phone (not shown) can slot into the holder 18 via the side in this embodiment. The phone is used as input means to configure the strap in this embodiment, via a suitable app. This can be used to customise the threshold value(s) of the strap. It can also allow customisation of the alert that is issued if the threshold is breached. It can also be used to customise the delay time until the alert is issued. It may also customise the locations in which alerts are suppressed (or actively permitted).

The holder 18 includes a casing 20 which is releasably attached to the body 12 of the strap 10. The casing 20 includes a battery. The holder 18 includes a combination lock to keep contents in the holder 18 secure. An aperture 18*a* in the holder allows earphones, for example, to be connected to a device in the holder. A slot 18*b* is provided through the holder at the level of a microphone in the device in the holder. The holder 18 may allow the device touchscreen to be operated when it is inside the holder 18. For example, in some embodiments, a thin and/or transparent front wall may be provided to enable this.

When the phone is in the holder, power is transferable from the battery to the phone. A distress button 21 is provided on the holder 18. When pressed, the strap 10 transmits a distress signal, e.g. directed to the emergency services. This may initiate a call via the electronic device, for example.

A camera 22 is provided at the front of the holder 18. The camera 22 is connected to the control unit 16. The camera 22 includes a night-vision mode. A data storage device 24 is mountable in the casing 20. When the camera 22 is recording, images are either wirelessly sent to the phone for storage or recorded locally on the data storage device 24.

Alert units 26*a*, 26*b* are provided on the strap. Each alert unit 26*a*, 26*b* includes a vibrator. The vibrators are spaced apart along the strap 10. Each vibrator is connected to the control unit 16. If the wearer has moved away from their phone beyond the threshold in the control unit 16, then the relevant vibrator will vibrate to indicate a turning direction for reaching the phone via the shortest route.

One or both alert units 26*a*, 26*b* include a speaker. The speaker or speakers are connected to the control unit 16. If the wearer has moved away from their phone beyond the threshold in the control unit 16, then the speaker(s) will play the set song for reminding the wearer to go back for the phone.

A security or authentication unit 28 is disposed on a rear surface of the strap 12 (facing the body when worn). The unit 28 is disposed between the vibrators. The unit 28 includes a unique token or barcode for verifying the authenticity of the strap 10. This is used when linking the strap to a remote monitoring station.

A strap tightening mechanism 30 is provided on the strap 10. This prevents the strap being pulled upwards or downwards off the wearer. In this embodiment it is provided between the alert and security units 26*a*, 26*b*, 28. However, it will be appreciated that the tightening mechanism could be provided at another position on the strap 10.

The unit 28 includes an alarm system, which includes alarm triggers extending along the body 12 in either direction. The triggers in this embodiment are in the form of a wire running through the body 12. If the strap 10 is cut, the alarm system activates and sends a distress signal to the remote monitoring station. The information in the signal can be assessed and assistance dispatched as needed. The camera 22 automatically sends images to the remote monitoring station if the distress signal is sent. Where multiple cameras are provided (e.g. spaced out around the strap 10 at 90 degree intervals, to provide front-, rear- and side-facing cameras), some or all of the cameras can send images.

In use, the phone is accidentally left on a table and the strap-wearer walks away from it. The phone is stationary and the strap 10 is in motion. When the threshold distance is breached, the control unit 16 activates an alert via one or more of the speaker(s), the vibrator(s) and/or the phone (sending a suitable signal via the wireless communication system), optionally according to a user-set configuration. The wearer is then aware of the situation, and can return to collect their phone straightaway. Returning to within the threshold distance deactivates the alert(s). A different alert or set of alerts may be used if the control unit 16 detects that the phone is moving relative to the strap 10, such as when stolen.

The strap 10 is connectable to a remote monitoring station as part of a personal monitoring system including the strap and the phone. If there is a situation which appears to place the wearer in danger, the monitoring station is able to evaluate sensory information provided from the belt (and/or the phone) to determine whether to contact emergency services to provide assistance.

It will be appreciated that some of the components described with respect to the strap 10 may in alternate embodiments be provided in an electronic device, such as a mobile phone, instead of or in addition to the components being in the strap. This would enable the device to monitor the distance to the strap, instead of or in addition to the other way round, as indicated with respect to the second aspect of the invention. If both the strap and the phone detect/monitor the distance to each other, this provides a backup in case the detector in one of the device or strap should fail or be blocked from detecting the other of the device or strap.

Figure 2:
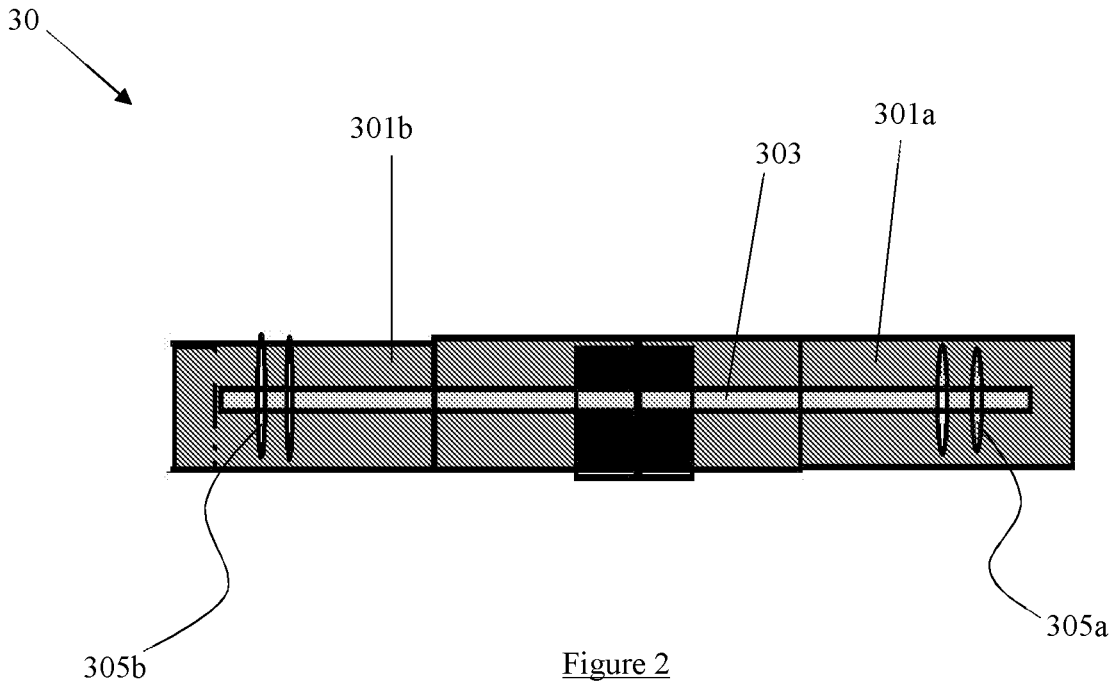
FIG. 2 shows a view of a tightening mechanism according to an embodiment of the invention.

FIG. 2 shows one embodiment of the tightening mechanism 30. The tightening mechanism comprises a first attachment means 301*a* and a second attachment means 301*b* for attaching the tightening mechanism 30 to the strap and an adjustment rod 303. The first attachment means 301*a* has a first set of coupling means 305*a*, and the second attachment means 301*b* has a second set of coupling means 305*b*. Although not apparent from FIG. 2, the attachment means 301 may be secured to the strap or embedded within the strap. For example, the attachment means 301 may be secured by an adhesive or stitching.

The adjustment rod 303 has a first threaded portion at one end of the rod and a second threaded portion at the end opposite the first threaded portion. The first threaded portion is received in a threaded portion of each coupling means of the first set of coupling means 305*a*. The second threaded portion is received in a threaded portion of each coupling means of the second set of coupling means 305*b*. The handedness of the threaded portions are designed so that rotation of the rod about its longitudinal axis causes the first set of coupling means and second set of coupling means to move towards or away from the central position of the rod thereby increasing or decreasing the distance between the attachment plates which tightens or loosens the strap.

Figure 3:
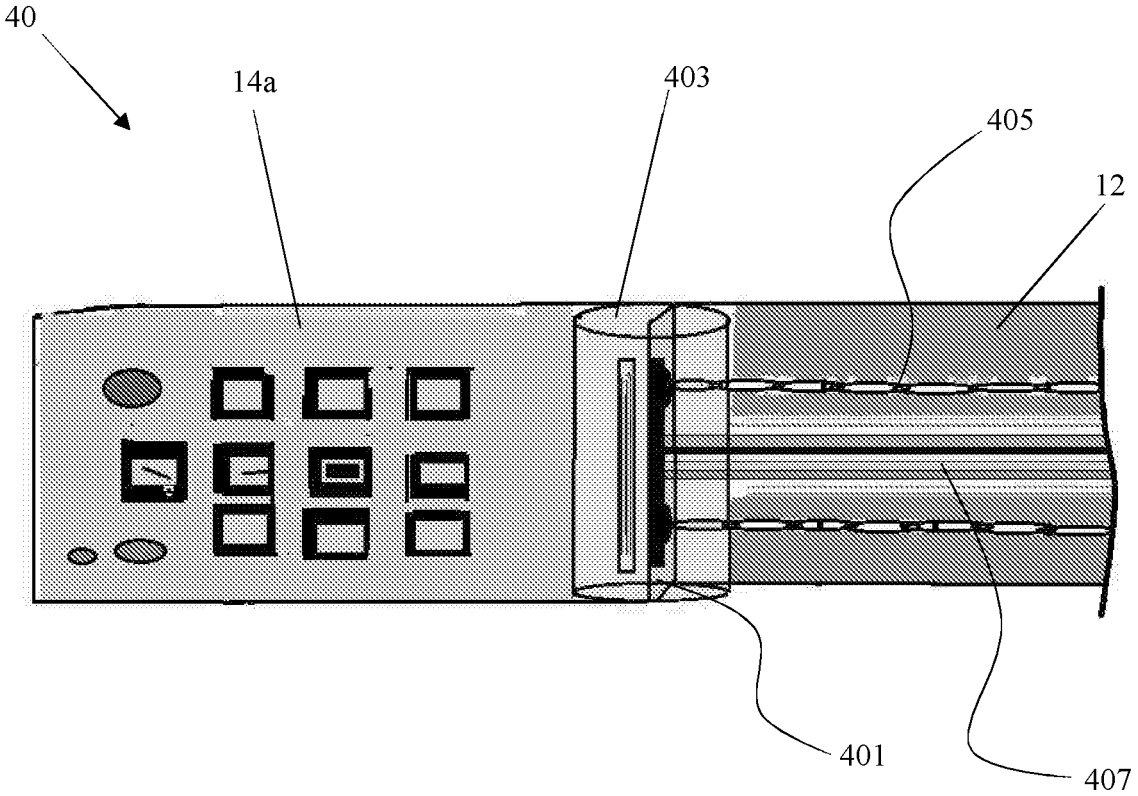
FIG. 3 shows a view of the connection means and storage means according to an embodiment of the invention.

FIG. 3 shows one embodiment of the connection means 14 which includes a strap storage means 40. In the current embodiment, the storage means 40 comprises a spool 401 with one end of the strap body 12 attached thereto and a cylindrical housing 403 attached to the first part 14*a* of the buckle. Although not shown in FIG. 3, the second part 14*b* of the buckle is disposed on the other end of the strap body 12 and when connected with the first part 14*a*, the strap forms a closed loop when worn around the waist in a conventional manner.

The storage means 40 allows for at least a portion of the strap body 12 to be stored in a rolled-up configuration. The spool 401 may be connected to a mechanism (not shown) for retracting the strap body 12 into the cylindrical housing 403. The spool 401 has a cylindrical central body (not shown) with a ratchet (not shown) at each end of the spool.

In some embodiments the mechanism is manual and has a handle rotatably coupled to the spool. In other embodiments the mechanism provides for automatic retraction. The retraction mechanism comprises a biasing element, such as a spiral spring, that biases the strap body into a rolled configuration.

In some embodiments, the storage means 40 includes a locking mechanism (not shown) for preventing the sudden withdrawal of the strap body from the cylindrical housing. The locking mechanism may comprise a centrifugal clutch. The centrifugal clutch comprises a pivotable lever on the spool which is weighted and biased so that when the spool is rotated quickly the centrifugal force drives the weighted end of the lever outwards. The pivotable lever, when driven outwards by centrifugal force, interfaces with a cam plate. The cam plate has a pin received in an aperture of a pawl. The pivotable lever causes the cam plate to move with the pin translating that movement to the pawl. The pawl then interfaces with the ratchet on the spool preventing movement of the spool.

In the current embodiment, the body 12 of the strap includes at least two chains 405 which act as reinforcement means to prevent cutting and a plurality of conductive wires 407. In other embodiments, a single chain or at least one woven metal wire acts as the reinforcement means. The reinforcement means may also act as the alarm trigger extending around the body of the belt discussed above. The plurality of conductive wires 407 can act as the alarm trigger. Furthermore, the plurality of wires can provide a connection for power, data and signals to be transmitted to and from the cameras.

Figure 4:
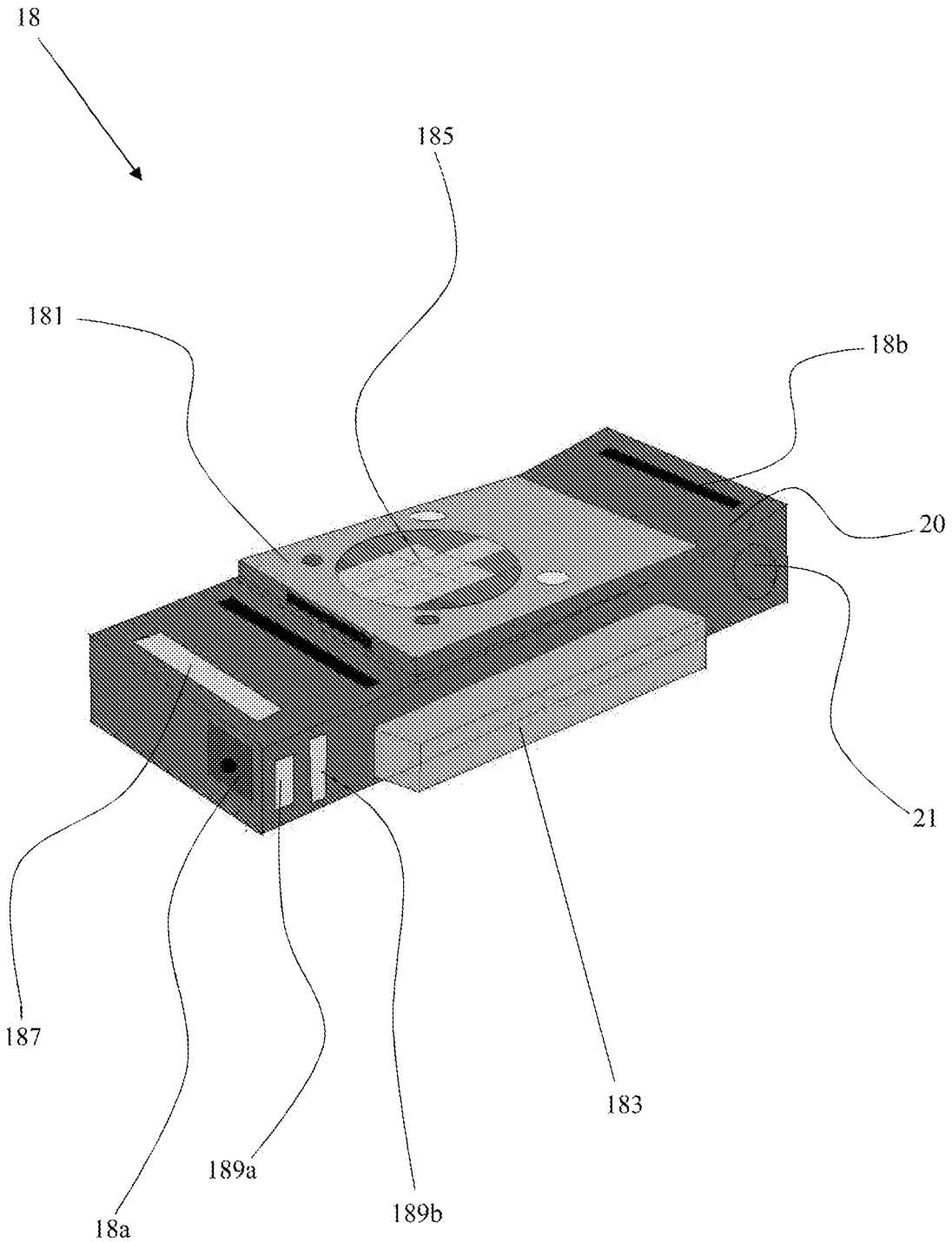
FIG. 4 shows an embodiment of the holder according to an embodiment of the invention.

FIG. 4 shows an embodiment of the phone holder 18. The phone holder has a casing 20 which is releasably attached to the body of the strap. The releasable attachment means (not shown) is only accessible when the body of the strap is not encircling an individual. A lockable door 181 is provided in the front of the casing 20. The lockable door 181 provides a cavity for receiving a phone, or other valuables (not shown). In the current embodiment, the phone is used as an input means to configure the strap.

An external battery compartment 183 is provided in the casing. The external battery compartment 183 allows access to the battery without having to open the lockable door 181. The external battery housing is accessible through the cavity.

Alternatively, there is a means to provide power from the battery in the external battery compartment to the cavity.

An input means 185 is provided in the front of the housing 20, the input means may be disposed in the lockable door 181 or a separate part of the housing 20. The input means 185 may be a physical keyboard or a digital touch screen. This allows a user to input various commands and interact with the functions of the holder 18 including entering a code to unlock the lockable door 181.

A screen 187 is provided in the front of the housing 20. The screen 187 allows a user to view input from the input means 185.

A first indicator 189*a* and a second indicator 189*b* are provided on the housing 18. The first indicator 189*a* is an array of LEDs used to indicate the state of charge of the battery. The state of charge may be indicated by colour or by number of LEDs illuminated. The second indicator 189*b* may be used to indicate the status of the connection. For example, it may indicate if the wearable strap has connected correctly or if there is an issue.

The embodiments described above are provided by way of example only. Various modifications will be apparent to persons skilled in the art without departing from the scope of the present invention as defined by the claims.

What is claimed is:

1. A wearable strap comprising:

a releasable connection means which is configurable between an unfastened state, and a fastened state for securing the strap around part of a person's body, a detector for wirelessly detecting an electronic device, a controller programmed with at least one predetermined threshold for a distance between the strap and electronic device, and at least one of:

a) an alert means including at least a speaker or vibrator in the strap, and b) a signalling means in the strap for sending a signal to a remote location, such as initiating an alert from the electronic device; the controller being configured to use the detector to monitor the distance between the strap and electronic device, and the controller being configured to initiate one or both of the alert means and the signalling means to provide an audible alert or a vibrating alert when the distance between the strap and the electronic device exceeds a first predetermined threshold, in which the controller is configurable to suppress or not initiate the audible alert or vibrating alert if the distance between the strap and the electronic device exceeds the first predetermined threshold when the releasable connection means of the strap is in the unfastened state.

2. The strap as claimed in claim 1, in which the strap is provided in or as part of a belt.

3. The strap as claimed in claim 1, in which the controller is configured to cease the audible alert or vibrating alert when the distance between the strap and electronic device is decreased below a second predetermined threshold, or below the first predetermined threshold.

4. The strap as claimed in claim 1, in which the signalling means includes a wireless communication system for wirelessly connecting the strap to the electronic device, the wireless communication system being configured to initiate the alert by sending a signal instructing the electronic device to provide the alert.

5. The strap as claimed in claim 1, in which the strap includes a location sensor, and the controller is connected to the location sensor and configurable to set at least one custom location where alerts are suppressed when the strap is in the at least one custom location.

6. The strap as claimed in claim 1, in which the detector is configured to passively detect a signal or field generated by the electronic device, the at least one predetermined threshold including a signal threshold or a field strength threshold, and the controller is configured to initiate one or both of the alert means and the signalling means when the strength of the signal or field drops below the signal threshold or field strength threshold.

7. The strap as claimed in claim 1, in which the controller is configured to distinguish between i) movement of the strap away from the electronic device, and ii) movement of the electronic device away from the strap.

8. The strap as claimed in claim 1, in which the controller is configured to use data from a movement sensor in the strap or the electronic device to determine whether to initiate the alert means or signalling means.

9. The strap as claimed in claim 1, in which a plurality of vibrators are spaced along the strap, and the controller is configured to control vibrations generated by the plurality of vibrators based on a detected relative location for the electronic device, for indicating the direction to the electronic device.

10. The strap as claimed in claim 1, in which at least one dummy camera is mounted in or to the strap.

11. The strap as claimed in claim 1, in which at least one optical device is mounted in or to the strap, wherein the optical device optionally includes a night-vision mode.

12. The strap as claimed in claim 11, in which the strap includes a data storage device or a port for receiving a data storage device, and the optical device is connected to the data storage device or port for storing one or more recorded images.

13. The strap as claimed in claim 11, in which the controller is configured to send one or more recorded images from the optical device to the electronic device.

14. The strap as claimed in claim 1, in which an electronic device holder is connected to the strap, wherein the electronic device holder is optionally adjustable for accommodating the size of a given electronic device, and wherein the strap comprises a power source and a charging system for transferring power from the power source to the electronic device via the electronic device holder when the electronic device is held in the electronic device holder.

15. The strap as claimed in claim 1, in which an authentication token is included in the strap or provided on a wearer-facing surface of the strap.

16. The strap as claimed in claim 1, in which the strap includes a location tracking system for remotely determining a location of the strap.

17. The strap as claimed in claim 1, comprising an alarm system including an alarm trigger disposed along the strap, wherein the alarm system is connected to the controller for initiating an alarm if the alarm trigger is cut.

18. The strap as claimed in claim 1, comprising input means for configuring the strap, such as configuring one or more of the controller, the alert means, and the signalling means.

19. A wearable strap and an electronic device configurable to communicate with the strap, the strap comprising releasable connection means which is configurable between an unfastened state, and a fastened state for securing the strap around part of a person's body, and the electronic device comprising a detector for wirelessly detecting the strap, and a controller programmed with at least one predetermined threshold for a distance between the electronic device and strap, wherein one or both of (a) and (b) are provided:

a) the electronic device includes a first alert means including at least a speaker or vibrator, and b) the strap includes a second alert means including at least a speaker or a vibrator, and the electronic device includes signalling means for sending a signal to the strap for initiating the second alert means of the strap;

wherein the controller in the electronic device being configured to use the detector to monitor the distance between the electronic device and the strap, and the controller being configured to initiate one or both of the alert means and the signalling means to provide an audible alert or a vibrating alert when the distance between the electronic device and the strap exceeds a first predetermined threshold, in which the controller is configurable to suppress or not initiate the audible alert or vibrating alert if the distance between the strap and the electronic device exceeds the first predetermined threshold when the releasable connection means of the strap is in the unfastened state.

20. A personal monitoring system comprising at least one wearable strap as claimed in claim 1, at least one electronic device for the at least one wearable strap, and a monitoring station at a location remote from the at least one wearable strap, in use, the at least one wearable strap transmitting information to the monitoring station via the signalling means to enable remote evaluation of an event in the vicinity of the at least one wearable strap.

* * * * *